US010213062B2

(12) United States Patent
Nilsson et al.

(10) Patent No.: US 10,213,062 B2
(45) Date of Patent: Feb. 26, 2019

(54) PUMP FOR DISPENSING FLUIDS

(71) Applicant: SCA Hygiene Products AB, Göteborg (SE)

(72) Inventors: Hugo Nilsson, Ljungby (SE); Peter Bergman, Göteborg (SE); Håkan Lindström, Göteborg (SE)

(73) Assignee: SCA HYGIENE PRODUCTS AB, Göteborg (SE)

( * ) Notice: Subject to any disclaimer, the term of this patent is extended or adjusted under 35 U.S.C. 154(b) by 0 days.

(21) Appl. No.: 15/762,827

(22) PCT Filed: Sep. 25, 2015

(86) PCT No.: PCT/EP2015/072143
§ 371 (c)(1),
(2) Date: Mar. 23, 2018

(87) PCT Pub. No.: WO2017/050390
PCT Pub. Date: Mar. 30, 2017

(65) Prior Publication Data

US 2018/0289222 A1 Oct. 11, 2018

(51) Int. Cl.

| | |
|---|---|
| ***B05B 11/00*** | (2006.01) |
| ***A47K 5/12*** | (2006.01) |
| ***A47K 5/14*** | (2006.01) |

(52) U.S. Cl.
CPC ..... *A47K 5/1207* (2013.01); *A47K 5/1209* (2013.01); *A47K 5/14* (2013.01);
(Continued)

(58) Field of Classification Search
CPC ..... A47K 5/1207; A47K 5/1209; A47K 5/14; B05B 11/00412; B05B 11/0054;
(Continued)

(56) References Cited

U.S. PATENT DOCUMENTS 1,687,317 A 10/1928 Archer
2,492,058 A * 12/1949 O'Connor ..... B43K 7/02 222/214
(Continued)

FOREIGN PATENT DOCUMENTS

AU 658398 4/1995
CA 2117205 A1 9/1995
(Continued)

OTHER PUBLICATIONS

Internet site: Series SP Belleville Springs, available at https://www.fandisc.com/disc-springs-series-sp-belleville-spring-index.html (last visited Jul. 14, 2018).
(Continued)

*Primary Examiner* — Patrick M Buechner
*Assistant Examiner* — Michael J Melaragno
(74) *Attorney, Agent, or Firm* — Drinker Biddle & Reath LLP

(57) ABSTRACT

A pump for dispensing a fluid product from a product container, includes a unitary pump body defining an axis and including a pump chamber, a pump inlet and a pump outlet. The pump chamber is collapsible over an axially directed pumping stroke from an initial condition to a collapsed condition and is biased to return to its initial condition in a return stroke. An axially compressible spring is arranged to at least partially support the pump body during its collapse.

25 Claims, 12 Drawing Sheets

(52) U.S. Cl.
CPC .... *B05B 11/0054* (2013.01); *B05B 11/00412* (2018.08); *B05B 11/3029* (2013.01); *B05B 11/3033* (2013.01); *B05B 11/3035* (2013.01); *B05B 11/3064* (2013.01); *B05B 11/3077* (2013.01)

(58) Field of Classification Search
CPC ..... B05B 11/3029; B05B 11/3033; B05B 11/3035; B05B 11/3064; B05B 11/3077
USPC ..... 222/214
See application file for complete search history.

(56) References Cited

U.S. PATENT DOCUMENTS

| | | | | |
|---|---|---|---|---|
| 2,556,994 | A * | 6/1951 | Candolini | F16N 3/06 222/214 |
| 2,654,597 | A | 10/1953 | Barényi | |
| 2,821,330 | A * | 1/1958 | Meylan | F16N 3/06 222/207 |
| 2,849,159 | A * | 8/1958 | Kaufmann | A47L 15/4418 222/207 |
| 3,141,580 | A | 7/1964 | Rogers | |
| 3,190,632 | A | 6/1965 | Barényi | |
| 4,212,408 | A | 7/1980 | Valenzona | |
| 4,330,071 | A | 5/1982 | Ohlson | |
| 4,440,323 | A | 4/1984 | Benson | |
| 4,572,117 | A | 2/1986 | Yoshikawa | |
| 4,598,820 | A | 7/1986 | Murphy | |
| 4,753,423 | A | 6/1988 | Ukai et al. | |
| 5,435,195 | A | 7/1995 | Meier | |
| 6,227,240 | B1 | 5/2001 | Wu et al. | |
| 6,505,622 | B2 * | 1/2003 | Py | A61M 11/06 128/203.18 |
| 6,718,575 | B1 | 4/2004 | Lübeck et al. | |
| 6,729,505 | B2 * | 5/2004 | Ramsey | B05B 11/3001 222/321.9 |
| 6,811,298 | B2 | 11/2004 | Peñaranda et al. | |
| 6,971,553 | B2 | 12/2005 | Brennan et al. | |
| 7,867,204 | B2 | 1/2011 | Bartholomew et al. | |
| 7,984,728 | B2 | 7/2011 | Wynn, Jr. | |
| 7,987,738 | B2 | 8/2011 | Kaps et al. | |
| 8,011,901 | B2 | 9/2011 | Duncan | |
| 8,695,856 | B2 * | 4/2014 | Nilsson | A47K 5/1209 222/207 |
| 8,701,942 | B2 * | 4/2014 | Nilsson | A47K 5/1209 222/207 |
| 8,708,200 | B2 * | 4/2014 | Nilsson | A47K 5/1209 222/207 |
| 9,475,075 | B2 * | 10/2016 | Tada | F04B 9/14 |
| 9,725,228 | B2 * | 8/2017 | Py | A61F 9/0008 |
| 9,963,288 | B2 * | 5/2018 | Py | A61J 1/00 |
| 2002/0139816 | A1 | 10/2002 | Powling | |
| 2003/0047571 | A1 * | 3/2003 | Ramsey | B05B 11/3001 222/321.9 |
| 2007/0157991 | A1 * | 7/2007 | Robertson | A47K 5/1208 141/360 |
| 2008/0029556 | A1 | 2/2008 | Chen | |
| 2009/0071977 | A1 | 3/2009 | Abe | |
| 2009/0188994 | A1 | 7/2009 | Ray et al. | |
| 2010/0059550 | A1 | 3/2010 | Ciavarella et al. | |
| 2010/0320226 | A1 * | 12/2010 | Nilsson | A47K 5/1209 222/207 |
| 2010/0327019 | A1 * | 12/2010 | Nilsson | A47K 5/1209 222/214 |
| 2011/0036863 | A1 * | 2/2011 | Nilsson | A47K 5/1209 222/207 |
| 2012/0118915 | A1 | 5/2012 | Harper | |
| 2012/0308405 | A1 | 12/2012 | McNulty et al. | |
| 2013/0043279 | A1 * | 2/2013 | Hagleitner | A47K 5/1207 222/207 |
| 2013/0292419 | A1 | 11/2013 | Quinlan et al. | |
| 2014/0117053 | A1 | 5/2014 | Ciavarella et al. | |
| 2014/0158715 | A1 | 6/2014 | Wells | |
| 2014/0197196 | A1 | 7/2014 | Tederous et al. | |
| 2014/0205473 | A1 | 7/2014 | Ciavarella et al. | |
| 2015/0136122 | A1 | 5/2015 | Stuart et al. | |
| 2018/0263431 | A1 * | 9/2018 | Nilsson | B65D 47/2062 |
| 2018/0281004 | A1 * | 10/2018 | Nilsson | A47K 5/1209 |
| 2018/0289222 | A1 * | 10/2018 | Nilsson | B05B 11/00412 |

FOREIGN PATENT DOCUMENTS

| | | | |
|---|---|---|---|
| CA | 2657542 | A1 | 9/2009 |
| DE | 202011052296 | U1 | 2/2012 |
| EP | 2743503 | A1 | 6/2014 |
| GB | 191016046 | A | 8/1910 |
| GB | 893683 | A | 4/1962 |
| GB | 2109148 | A | 5/1983 |
| GB | 2329222 | A | 3/1999 |
| IT | 1132947 | B | 7/1986 |
| IT | MI20130336 | U1 | 4/2015 |
| JP | H10-47400 | A | 2/1998 |
| JP | H10-72052 | A | 3/1998 |
| WO | WO-99/49769 | A1 | 10/1999 |
| WO | WO-2000/20294 | A1 | 4/2000 |
| WO | WO-01/34485 | A1 | 5/2001 |
| WO | WO-02/02423 | A1 | 1/2002 |
| WO | WO-2003/047995 | A1 | 6/2003 |
| WO | WO-2009/104992 | A1 | 8/2009 |
| WO | WO-2009/104993 | A1 | 8/2009 |
| WO | WO-2009/104994 | A1 | 8/2009 |
| WO | WO-2009/142886 | A1 | 11/2009 |
| WO | WO-2011/133085 | A1 | 10/2011 |
| WO | WO-2013/22634 | A2 | 2/2013 |
| WO | WO-2013/035119 | A1 | 3/2013 |
| WO | WO-2013/035316 | A1 | 3/2013 |
| WO | WO-2013/055893 | A2 | 4/2013 |
| WO | WO-2013/103670 | A1 | 7/2013 |
| WO | WO-2013/114520 | A1 | 8/2013 |
| WO | WO-2013/181330 | A1 | 12/2013 |
| WO | WO-2014/036067 | A1 | 3/2014 |
| WO | WO-2014/126751 | A2 | 8/2014 |
| WO | WO-2014/209288 | A1 | 12/2014 |
| WO | WO-2015/27000 | A2 | 2/2015 |
| WO | WO-2015/083891 | A1 | 6/2015 |

OTHER PUBLICATIONS

Internet site: Dupont Hytrel polyester elastomer "Product and Properties Guide" found at http://www.engpolymer.co.kr/product/molding_guide/hytrel_product_guide.pdf (last visited Jul. 14, 2018).
Examination report No. 1 issued in Australian patent application No. 2015410277, dated Jul. 26, 2018.

* cited by examiner

PUMP FOR DISPENSING FLUIDS

CROSS-REFERENCE TO PRIOR APPLICATION

This application is a § 371 National Stage Application of PCT International Application No. PCT/EP2015/072143 filed Sep. 25, 2015, which is incorporated herein in its entirety.

TECHNICAL FIELD

The present disclosure relates to pumps of the type used for dispensing fluids and more particularly to a pump for dispensing cleaning, sterilising or skin care product, e.g. products such as soaps, gels, disinfectants, moisturizer and the like. The disclosure is specifically directed to pumps and springs that are axially compressible and that cause dispensing by an axial reduction in volume of a pump chamber.

BACKGROUND

Fluid dispensers of various types are known. In particular, for dispensing of cleaning products such as soaps, there are a wide variety of manually or automatically actuated pumps that dispense a given quantity of the product into a user's hand.

Consumer products may include a dispensing outlet as part of the package, actuated by a user pressing down the top of the package. Such packages use a dip tube extending below the level of the liquid and a piston pump that aspirates the liquid and dispenses it downwards through an outlet spout.

Commercial dispensers frequently use inverted disposable containers that can be placed in dispensing devices, affixed to walls of washrooms or the like. The pump may be integrated as part of the disposable container or may be part of the permanent dispensing device or both. Such devices are generally more robust and, as they are affixed to the wall, greater freedom is available in the direction and amount of force that is required for actuation. Such devices may also use sensors that identify the location of a user's hand and cause a unit dose of the product to be dispensed. This avoids user contact with the device and the associated cross-contamination. It also prevents incorrect operation that can lead to damage and premature ageing of the dispensing mechanism.

A characteristic of inverted dispensers is the need to prevent leakage. Since the pump outlet is located below the container, gravity will act to cause the product to escape if there is any leakage through the pump. This is particularly the case for relatively volatile products such as alcohol based solutions. Achieving leak free operation is often associated with relatively complex and expensive pumps. For the convenience of replacing empty disposable containers however, at least part of the pump is generally also disposable and must be economical to produce. There is therefore a need for a pump that is reliable and drip free, yet simple and economical to produce.

One disposable dispensing system that uses a pump to dispense a unit dose of fluid from an inverted collapsible container has been described in WO2011/133085. The pump, which in this case is described for dispensing foam includes a piston element and a cylinder that slide, one within the other to dispense the foam. Valves (not shown) are present to control inflow and outflow. The pump is a relatively complex item to manufacture and assemble due to the large number of components, all of which must be compatible with the different fluids that may be pumped. Since the pump is disposable, the presence of multiple components of different materials is also of concern. Additionally, although the sliding seal operates in a satisfactory manner, it remains a location where attention must be paid to contamination and leakage. It would be desirable to provide a pump that could be an alternative to existing axially operating dispensers.

SUMMARY

In view of the fluid pumps of the above-mentioned types, it is desired to provide an alternative pump. The pump may be disposable and is desirably reliable and drip free when used, yet simple, hygienic and economical to produce.

The disclosure relates in particular to a pump, a pump assembly, a disposable fluid dispensing package, a method, and a dispenser. Embodiments are set forth in the following description and in the drawings.

Thus, there is provided a pump for dispensing a fluid product from a product container, the pump including: a unitary pump body defining an axis and including a pump chamber, a pump inlet and a pump outlet, the pump chamber being collapsible over a pumping stroke directed along the axis from an initial condition to a collapsed condition and being biased to return to its initial condition in a return stroke; and an axially compressible spring, arranged to at least partially support the pump body during its collapse whereby axial compression of the spring generates a restoring force, at least partially biasing the pump chamber to its initial condition. As used herein, "collapse" refers to the fact that the pump chamber has reduced in volume by changing its shape either elastically or by flexing or both. Since the pump body is a unitary element, telescopic sliding of elements together is excluded. An advantage of the unitary pump body is that sliding seals are avoided and the complete pump is hermetically enclosed from inlet to outlet.

As indicated above, the chamber can collapse by changing its shape either elastically or by flexing or both. This change in shape can lead to the creation of a bias in the material of the chamber urging it to return to its initial condition in a return stroke. On the other hand, if the pump chamber is completely flexible without minimal elastic tendency in the area of operation, then the bias causing the return stroke may be entirely provided by the spring. When connected to a source of fluid such as a product container, this return stroke serves to increase the volume of the pump chamber and draw in fluid through the pump inlet.

The fluid may be soap, detergent, disinfectant, moisturizer or any other form of cleaning, sterilising or skin care product.

In one embodiment, the pump body includes plastomer material. In the present context, reference to plastomer material is intended to include all thermoplastic elastomers that are elastic at ambient temperature and become plastically deformable at elevated temperatures, such that they can be processed as a melt and be extruded or injection moulded.

The spring may be any element capable, at least partially, of biasing and providing support to the pump chamber during its collapse. In this context, support is intended to denote that it prevents the pump chamber from collapsing uncontrollably to a position in which it might not be able to restore itself. It may also assist in controlling the collapse to ensure a more constant recovery during the return stroke. It is noted that the pump body or the pump chamber may also provide support to the spring in order to allow it to compress axially in the desired manner. The spring is compressible, allowing it to collapse together with the pump chamber. The compression of the spring also serves in assisting the return of the pump chamber to its initial condition by providing or contributing to the bias that causes the return stroke. In one embodiment, the spring may also include plastomer material as defined above.

In one embodiment, the spring is located inside the pump chamber. In this configuration, the spring can at least partially support against an internal surface of the pump chamber during its collapse. This can prevent the pump chamber from buckling and can also ensure that the spring compresses axially e.g. without sideways distortion. The spring may have an external cross-sectional shape that corresponds to an internal cross-section of the pump chamber. The pump chamber may be cylindrical and the spring may also define a generally cylindrical envelope in this region.

In order that the spring can perform its support function, it may include a first end portion that engages with the pump inlet and a second end portion that engages with the pump outlet. A spring body or otherwise compressible portion of the spring may be located therebetween. The engagement of the respective end portions with the inlet and outlet may serve to transmit force from the compressed spring body to the pump chamber and vice-versa. The spring body will generally be located within the pump chamber and may provide its support at this location.

The pump may operate with valves that are located outside the pump e.g. in a product container or dispenser nozzle. In one embodiment, the pump also includes an inlet valve for allowing one way passage of fluid through the pump inlet and into the pump chamber and an outlet valve for allowing one way passage of fluid from the pump chamber through the pump outlet. An important aspect of the present disclosure is a reduction in the overall number of pieces required to implement the pump. Accordingly, it may be desirable that the inlet valve includes a first valve element, integrally formed with the first end portion. Furthermore, the outlet valve may also include a second valve element, integrally formed with the second end portion. The integration of one or more valve elements with the spring, reduces the number of components that must be manufactured and also simplifies the assembly operations. Given that these components are of the same type of material, their disposal may also be a single operation.

The spring may have any appropriate form, according to its location with respect to the pump body and pump chamber. In particular, the spring body may be helical, concertina-like, leaf-spring like or otherwise and may have an outer envelope corresponding to the interior of the pump chamber. The spring body may include one or more axially-aligned, spring sections, each of which can be compressed in the axial direction from an initial open condition to a compressed condition and is biased to subsequently expand to its open condition. The spring sections may have any appropriate shape in their initial open condition, including round, ellipse, rhombus or the like. They may also be rotationally symmetrical around the axis such as a circular concertina or two-dimensional, having a generally constant shape in one direction normal to the axis such as a leaf-spring. In an embodiment, the spring body includes two-dimensional or leaf spring sections. These have the advantage that they may be relatively easily moulded in a two part mould. They may also be less susceptible to twisting or distortion than helical springs. In a particular embodiment, spring sections are rhombus shaped, joined together in series at adjacent corners and aligned with each other in the axial direction. The sides of the rhombus shapes may include four flat leaves joined together along hinge lines that are parallel to each other and perpendicular to the axial direction.

In order to facilitate assembly of the pump body and the spring, the pump inlet may have an inner diameter greater than that of the pump outlet and the spring may taper from the first end portion to the second end portion. This allows the spring to be inserted into the pump body via the pump inlet. It may be retained in this position by engagement between the first end portion of the spring and a suitable engaging element within the pump inlet, such as a groove or ridge or the like. In one embodiment, the spring may be held in pre-tension in this position.

As indicated above, the material for the pump body and/or the spring may be a plastomer. A plastomer may be defined by its properties, such as the Shore hardness, the brittleness temperature and Vicat softening temperature, the flexural modulus, the ultimate tensile strength and the melt index. Depending on, for example, the type of fluid to be dispensed, and the size and geometry of the pump body or spring, the plastomer material used in the pump may vary from a soft to a hard material. The plastomer material forming at least the spring may thus have a shore hardness of from 50 Shore A (ISO 868, measured at 23 degrees C.) to 70 Shore D (ISO 868, measured at 23 degrees C.). Optimal results may be obtained using a plastomer material having a shore A hardness of 70-95 or a shore D hardness of 20-50, e.g. a shore A hardness of 75-90. Furthermore, the plastomer material may have brittleness temperature (ASTM D476) being lower than −50 degrees Celsius, e.g. from −90 to −60 degrees C., and a Vicat softening temperature (ISO 306/SA) of 30-90 degrees Celsius, e.g. 40-80 degrees C. The plastomers may additionally have a flexural modulus in the range of 15-80 MPa, 20-40 MPa, 30-50 MPa, or 25-30 MPa (ASTM D-790), e.g. 26-28 Mpa. Likewise, the plastomers may have an ultimate tensile strength in the range of 3-11 MPa, or 5-8 MPa (ASTM D-638). Additionally, the melt flow index may be at least 10 dg/min, or in the range of 20-50 dg/min (ISO standard 1133-1, measured at 190 degrees C.).

Suitable plastomers include natural and/or synthetic polymers. Particularly suitable plastomers include styrenic block copolymers, polyolefins, elastomeric alloys, thermoplastic polyurethanes, thermoplastic copolyesters and thermoplastic polyamides. In the case of polyolefins, the polyolefin may be used as a blend of at least two distinct polyolefins and/or as a co-polymer of at least two distinct monomers. In one embodiment, plastomers from the group of thermoplastic polyolefin blends are used, for example, from the group of polyolefin co-polymers. A particular group of plastomers is the group of ethylene alpha olefin copolymers. Amongst these, ethylene 1-octene copolymers have been shown to be particularly suitable, especially those having the properties as defined above. Suitable plastomers are available from ExxonMobil Chemical Co. as well as Dow Chemical Co.

The pump chamber may have any suitable cross-section although round or oval cross-sections may be generally advantageous. In one embodiment, the pump chamber includes a cylindrical wall. The pump chamber wall can also be relatively more flexible than the pump inlet and pump outlet, ensuring that collapse of the pump body takes place in the region of the pump chamber. The relatively more rigid pump inlet and pump outlet ensure better transfer of forces to the spring body that may be engaged therewith or from an actuating element that may act externally on the pump body to cause its collapse.

In a particular embodiment, the pump outlet has an outer diameter that is smaller than an outer diameter of the cylindrical wall of the pump chamber. This allows the cylindrical wall to collapse by inverting whereby the pump outlet is at least partially received within the pump chamber. The outer diameter of the pump outlet may even be smaller than an inner diameter of the pump chamber, allowing the inversion to take place with little or no stretching of the pump chamber wall in this region. Although reference above is given to the diameters of these components, this is not intended to be limiting on round cross-sections and other appropriate cross-sectional forms may also be employed. Additionally, although an embodiment is described in which the pump outlet is smaller than the pump chamber and received therein, the same principle may apply where the pump chamber inverts into the pump outlet. Furthermore, it will be understood that this will equally apply to arrangements where the pump inlet is arranged to invert or roll-up.

The cylindrical wall may be arranged such that its collapse generates a restoring force tending to bias the pump chamber to the initial condition. This restoring force may be present over the complete path of collapse or only at certain stages of collapse. The skilled person will be aware that inversion of a partially domed or conical form can be subject to non-linear collapse, as is the case for a Belleville washer. The above-described inversion of the pump chamber at the pump outlet may be an example of such an effect and may also exhibit hysteresis. Once an initial force to achieve inversion has been overcome, the subsequent force to continue the inversion or rolling up of the pump chamber may be lower.

The above non-linear characteristic of the pump chamber may be beneficially used in the disclosed pump. According to one aspect, the pump chamber and the spring may together bias the pump chamber to return to its initial condition. The spring may provide a major biasing force for the return stroke and the pump chamber may provide a lesser contribution or even none at all. This may be the case over the whole return stroke or it may be that over part of the stroke e.g. during an initial part of the return stroke the spring contributes a major portion of the force. In one embodiment, the pump chamber may provide a major biasing force over a part e.g. a final part of the return stroke. Seen from the perspective of the pumping stroke, the pump chamber may provide an initial greater resistance and the effect of the spring may thereafter increase during the pumping stroke.

In addition to the force provided by the compression of the spring and by the collapse of the pumping chamber, there may be additional effects from other sources both internally and externally to the pump. In one embodiment, a bias force may be generated by interaction between the spring and the pump chamber. These forces are referred to as radial forces, namely forces due to the interaction of the spring acting against the pump chamber in a radial direction e.g. causing radial expansion thereof. In a further embodiment, all of the bias causing the pump chamber to return to its initial condition is provided by sources internally to the pump i.e. by the spring or by the pump body.

In terms of spring constants, the skilled person will understand that the overall spring constant for the pump may be aggregated from three sources:

a. The spring (Ks).

b. The walls of the pump chamber (Kc)

c. The radial effects (Kr), where the spring engages an interior wall of the pump chamber thereby expanding the pump chamber in the radial direction. This expansion and subsequent relaxation, contributes to the spring constant of the total combination.

The total spring constant Kt of the assembled pump is a combination of Ks, Kc and Kr. The value of this total spring constant also varies during the stroke, whereby Kt is a non-linear spring. A benefit of this feature may be that the spring constant increases during part of the cycle to give an extra bias during certain parts of the return stroke.

As discussed above, the relative contribution of each of the individual sources can vary and also vary over the pump/return stroke. Ks may be dominant throughout return stroke, while Kc and/or Kr may in such a case contribute to the spring constant during part of the cycle to level the bias or to give an extra bias during certain parts of the return stroke.

The pump body is formed as a unitary element. In this context unitary is intended to denote that the pump body has no sliding seals or joints in order to change its volume to perform its pumping function. Nevertheless, it is not excluded that the pump body may be formed of separate elements that are assembled together, e.g. by gluing, welding or otherwise. In particular, the pump inlet and/or the pump outlet may be assembled to the pump chamber. In an embodiment, the pump body is integrally formed, i.e. manufactured in a single piece, e.g. by injection moulding.

In one embodiment, the pump outlet may define a nozzle that can also be integrally formed with a frangible closure element. This ensures that the pump body is hermetically closed at its outlet end prior to use and can be opened by a user removing the frangible closure. The frangible closure may be in the form of a twist-off closure i.e. an element that can be twisted or torn off by a user prior to use. A line of weakness may connect the frangible closure to the pump outlet. The pump body may then be provided to a user, connected to a product container, whereby access to the product is by removal of the frangible closure.

Various manufacturing procedures may be used to form the pump including blow moulding, thermoforming, 3D-printing and other methods. Some or all of the elements forming the pump may be manufactured by injection moulding. In a particular embodiment, the pump body, the spring and the valves may each be formed by injection moulding. They may all be of the same material or each may be optimised independently using different materials. As discussed above, the material may be optimised for its plastomer qualities and also for its suitability for injection moulding. Additionally, although in one embodiment, the spring is manufactured of a single material, it is not excluded that it may be manufactured of multiple materials.

In the case that the spring is integrally formed to include inlet and outlet valves, the designer is faced with two conflicting requirements, to a large degree depending on the fluid that will be pumped:

1. The valves shall be flexible enough to allow for a good seal;

2. The spring shall be stiff enough to provide the required spring constant to pump the fluid.

The skilled person will understand that these considerations may be achieved in a number of different ways. Thus, using a single material there may be an optimum geometry where both conflicting requirements can be solved by the same material. In this case, the spring can be produced by means of standard single-component injection moulding. In an alternative, in order to increase the spring constant in relationship to the valve rigidity, the geometry of the spring may be altered so as produce a stiffer spring. This may only be possible within certain boundaries since it may also impact the available volume of the pumping stroke.

If no solution to the above conflicting requirements can be achieved by altering the geometry, the material of the different parts can be changed, meaning that one or both valves may be made in a material different to that of the spring. Thus, the spring-valve component can be made of up to three different materials. It is not excluded that the spring may be made of a very stiff plastic material or even other materials such as stainless steel whereas the valves may be formed of soft plastic material. This may be accomplished using 2- or 3-component moulding, over-molding or other advanced production techniques.

The stiffness of the spring and valves may be fine-tuned by adding a certain percentage of a stiffer material from the same chemical family to the original base plastomer material. In doing so, a more robust soap with higher viscosity can be accommodated only by slightly stiffening the material while avoiding expensive and complex changes in the mould and component geometry.

It is thus clear that by modifying the material content, the same injection moulding tool for forming a given part of the pump may be used for forming pumps for dispensing a wide variety of fluids.

In a particular embodiment, the pump may consist of only two components, namely the pump body and the spring. The pump body and the spring may thus include portions that interact to define a one-way inlet valve and a one-way outlet valve. The valve elements may be provided on the spring with valve seats being provided on the pump body or vice-versa. It will also be understood that the inlet valve may be distinct from the outlet valve in this respect.

The disclosure also relates to a pump assembly including the pump as described above or hereinafter together with a pair of sleeves, arranged to slidably interact with each other to guide the pump during a pumping stroke. The sleeves may include a stationary sleeve engaged with the pump inlet and a sliding sleeve engaged with the pump outlet. It will be understood that these terms are merely for identification and that the actual movement is relative i.e. the sliding sleeve may be fixed while the stationary sleeve moves to perform the pumping stroke.

In one embodiment, the stationary sleeve and sliding sleeve have mutually interacting detent surfaces that prevent their separation and define the pumping stroke. They may be separately manufactured of a relatively harder material than the pump body e.g. polycarbonate or the like and may be connected together around the pump body during an assembly step. Irreversible in this context is intended to denote that the connection is not intended to be opened by a user, at least not without damage to the sleeves.

In one embodiment, the stationary sleeve includes a socket having an axially extending male portion and the pump inlet has an outer diameter, dimensioned to engage within the socket and including a boot portion, rolled over on itself to receive the male portion. The provision of such a socket and boot portion is advantageous in achieving a seal that can be connected to an outlet or neck of a product container. In particular, the material of the boot portion of the pump body can be compressed between the relatively harder material of the male portion of the socket and the container neck.

The disclosure still further relates to a disposable fluid dispensing package, including a pump or a pump assembly as described above or hereinafter, sealingly connected to a collapsible product container. The product container may contain a volume of fluid to be dispensed and the pump body may be closed by a frangible closure that may be opened for use. The fluid may be soap, detergent, disinfectant, moisturiser or any other form of cleaning, sterilising or skin care product. It may be in the form of a liquid, gel, dispersion, emulsion and even include particulates. The pump may dispense the fluid as a liquid jet, spray, droplets or otherwise.

The disclosure also relates to a method of dispensing a fluid from a pump, the method comprising: exerting an axial force on the pump body between the pump inlet and the pump outlet to overcome a bias force and cause the pump chamber to collapse from an initial condition to a collapsed condition, whereby fluid contained in the pump chamber is dispensed through the pump outlet; releasing the axial force, allowing the bias force to return the pump chamber to its initial condition, whereby fluid is drawn into the pump chamber through the pump inlet. Still further, the disclosure relates to a mould for injection moulding and having the shape of a spring as herein described.

In one embodiment of the method, during a first portion of the return stroke, the bias force is primarily provided by the spring and in a final portion of the return stroke, the bias force is primarily provided by the pump body. The method may take place in a dispensing system using a dispenser that acts on the pump or the pump assembly to exert the axial force. This axial force may be due to manual actuation or be automated.

The disclosure still further relates to a dispenser, configured to carry out the disclosed method on a disposable fluid dispensing package as disclosed and claimed herein.

BRIEF DESCRIPTION OF THE DRAWINGS

The features and advantages of the present disclosure will be appreciated upon reference to the following drawings of a number of exemplary embodiments, in which.

DESCRIPTION OF ILLUSTRATIVE EMBODIMENTS

Figure 1:
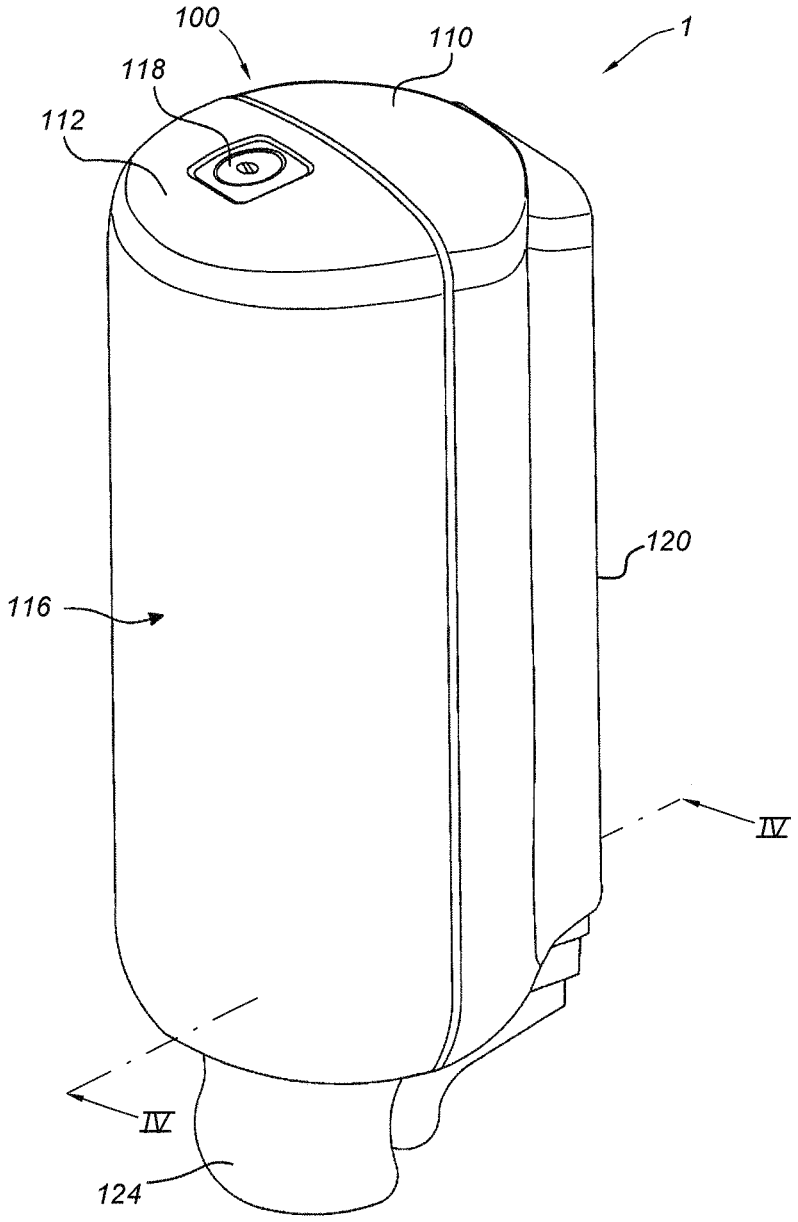
FIG. 1 shows a perspective view of a dispensing system.

FIG. 1 shows a perspective view of a dispensing system 1. The dispensing system 1 includes a reusable dispenser 100 of the type used in washrooms and the like and available under the name Tork™ from ESSITY HYGIENE AND HEALTH AKTIEBOLAG. The dispenser 100 is described in greater detail in WO2011/133085, the contents of which are incorporated herein by reference in their entirety. It will be understood that this embodiment is merely exemplary and that the present invention may also be implemented in other dispensing systems.

The dispenser 100 includes a rear shell 110 and a front shell 112 that engage together to form a closed housing 116 that can be secured using a lock 118. The housing 116 is affixed to a wall or other surface by a bracket portion 120. At a lower side of the housing 116 is an actuator 124, by which the dispensing system 1 may be manually operated to dispense a dose of cleaning fluid or the like. The operation, as will be further described below, is described in the context of a manual actuator but the present disclosure is equally applicable to automatic actuation e.g. using a motor and sensor.

Figure 2:
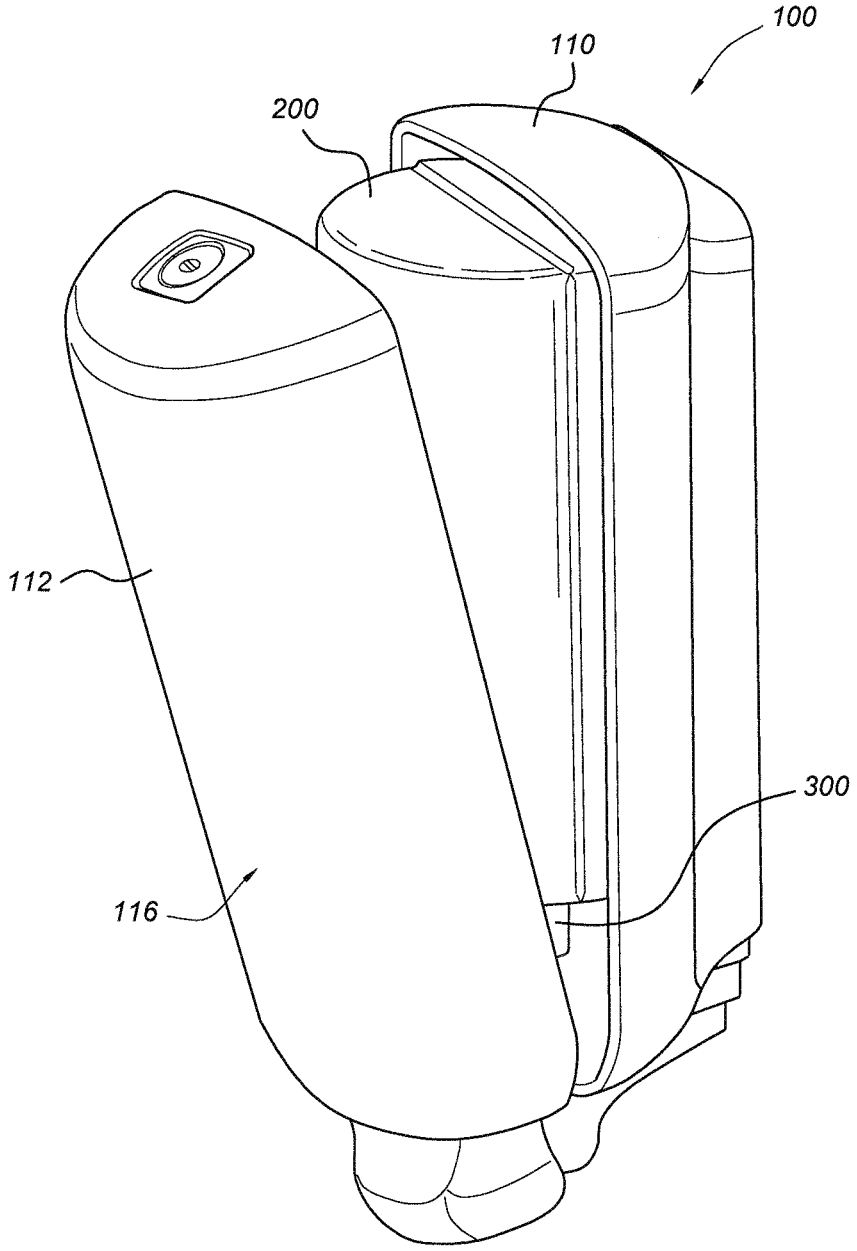
FIG. 2 shows the dispensing system of FIG. 1 in an open configuration.

FIG. 2 shows in perspective view the dispenser 100 with the housing 116 in the open configuration and with a disposable container 200 and pump assembly 300 contained therein. The container 200 is a 1000 ml collapsible container of the type described in WO2011/133085 and also in WO2009/104992, the contents of which are also incorporated herein by reference in their entirety. The container 200 is of generally cylindrical form and is made of polyethylene. The skilled person will understand that other volumes, shapes and materials are equally applicable and that the container 200 may be adapted according to the shape of the dispenser 100 and according to the fluid to be dispensed.

The pump assembly 300 has an outer configuration that corresponds substantially to that described in WO2011/133085. This allows the pump assembly 300 to be used interchangeably with existing dispensers 100. Nevertheless, the interior configuration of the pump assembly 300 is distinct from both the pump of WO2011/133085 and that of WO2009/104992, as will be further described below.

Figure 3:
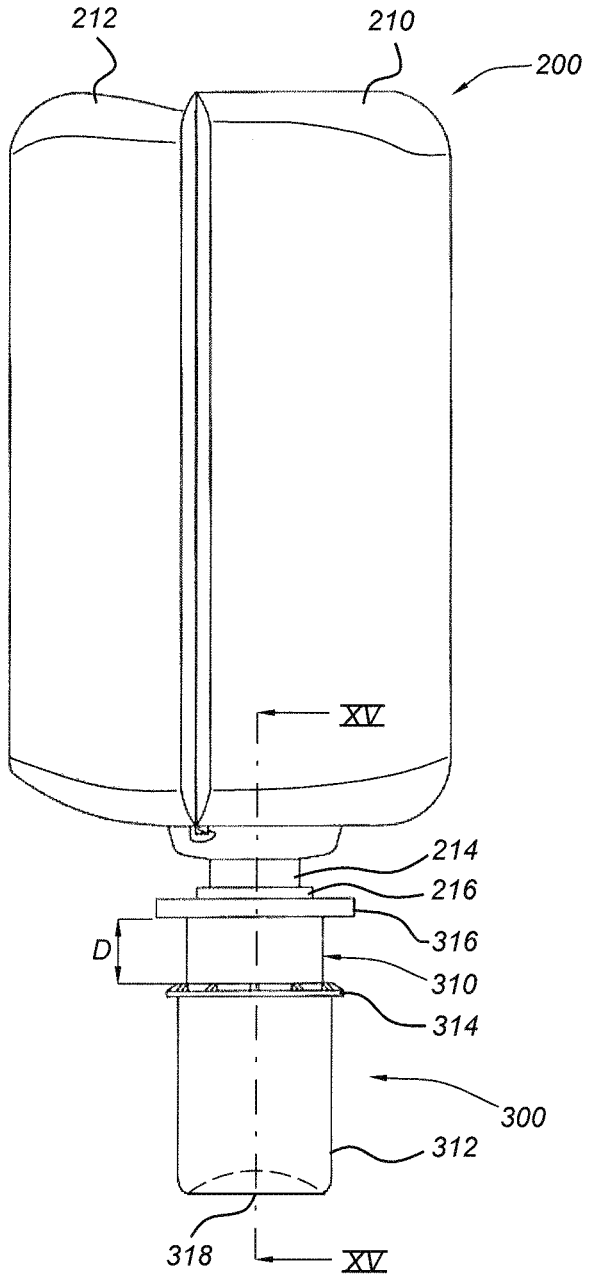
FIG. 3 shows a disposable container and pump assembly in side view.

FIG. 3, shows the disposable container 200 and pump assembly 300 in side view. As can be seen, the container 200 includes two portions, namely a hard, rear portion 210 and a soft, front portion 212. Both portions 210, 212 are made of the same material but having different thicknesses. As the container 200 empties, the front portion 210 collapses into the rear portion as liquid is dispensed by the pump assembly 300. This construction avoids the problem with a build-up of vacuum within the container 200. The skilled person will understand that although this is a preferred form of container, other types of reservoir may also be used in the context of the present disclosure, including but not limited to bags, pouches, cylinders and the like, both closed and open to the atmosphere. The container may be filled with soap, detergent, disinfectant, skin-care liquid, moisturizers or any other appropriate fluid and even medicaments. In most cases, the fluid will be aqueous although the skilled person will understand that other substances may be used where appropriate, including oils, solvents, alcohols and the like. Furthermore, although reference will be made in the following to liquids, the dispenser 1 may also dispense fluids such as dispersions, suspensions or particulates.

At the lower side of the container 200, there is provided a rigid neck 214 provided with a connecting flange 216. The connecting flange 216 engages with a stationary sleeve 310 of the pump assembly 300. The pump assembly 300 also includes a sliding sleeve 312, which terminates at an orifice 318. The sliding sleeve 312 carries an actuating flange 314 and the stationary sleeve has a locating flange 316. Both the sleeves 310, 312 are injection moulded of polycarbonate although the skilled person will be well aware that other relatively rigid, mouldable materials may be used. In use, as will be described in further detail below, the sliding sleeve 312 is displaceable by a distance D with respect to the stationary sleeve 310 in order to perform a single pumping action.

Figure 4A:
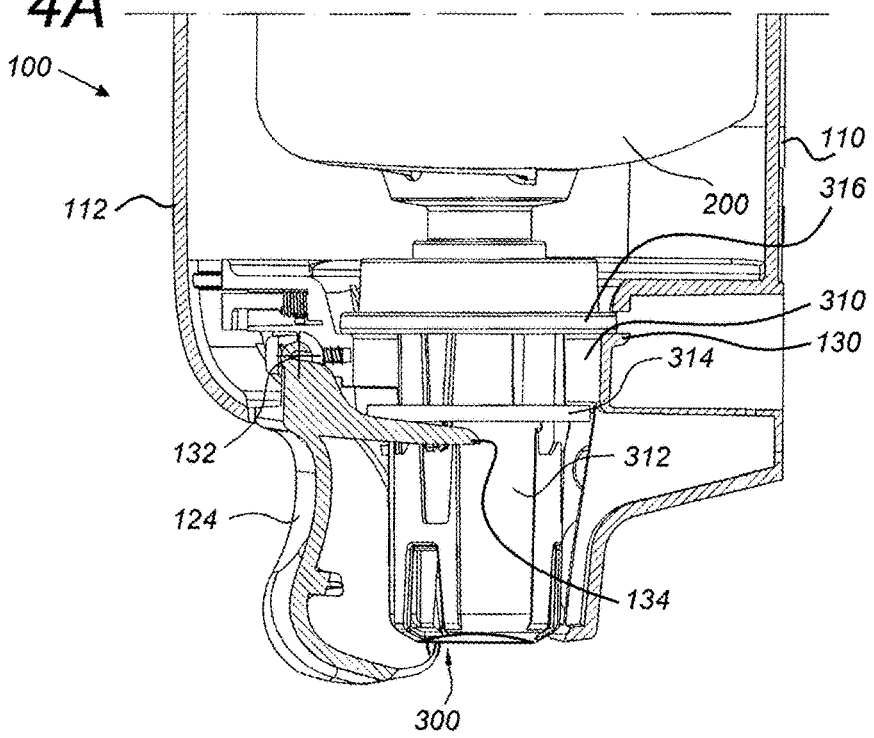
FIGS. 4A and 4B show partial cross-sectional views of the pump of FIG. 1 in operation.
Figure 4B:
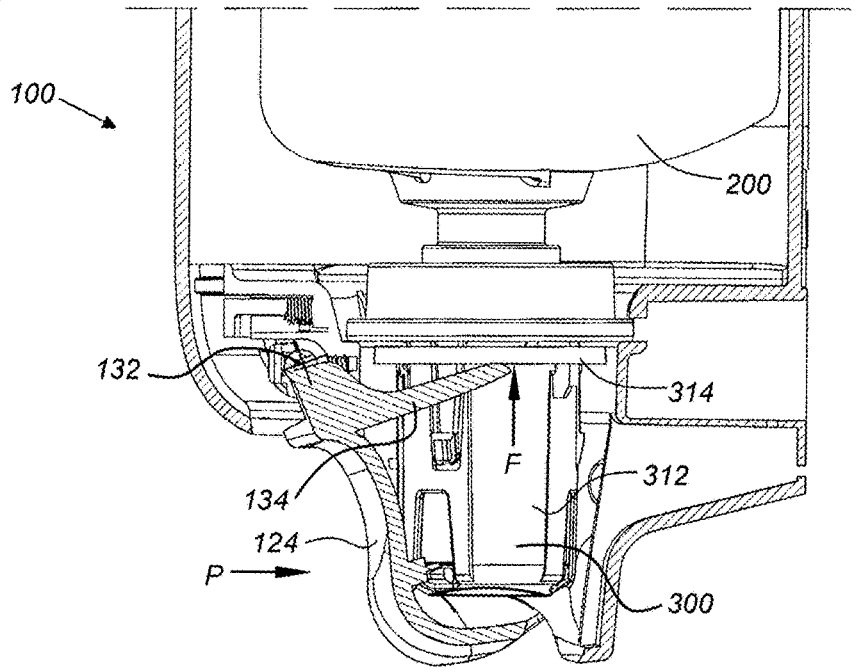

FIGS. 4A and 4B show partial cross-sectional views through the dispenser 100 of FIG. 1, illustrating the pump assembly 300 in operation. According to FIG. 4A, the locating flange 316 is engaged by a locating groove 130 on the rear shell 110. The actuator 124 is pivoted at pivot 132 to the front shell 112 and includes an engagement portion 134 that engages beneath the actuating flange 314.

FIG. 4B shows the position of the pump assembly 300 once a user has exerted a force P on actuator 124. In this view, the actuator 124 has rotated anti-clockwise about the pivot 132, causing the engagement portion 134 to act against the actuating flange 314 with a force F, causing it to move upwards. Thus far, the dispensing system 1 and its operation is essentially the same as that of the existing system known from WO2011/133085.

Figure 5:
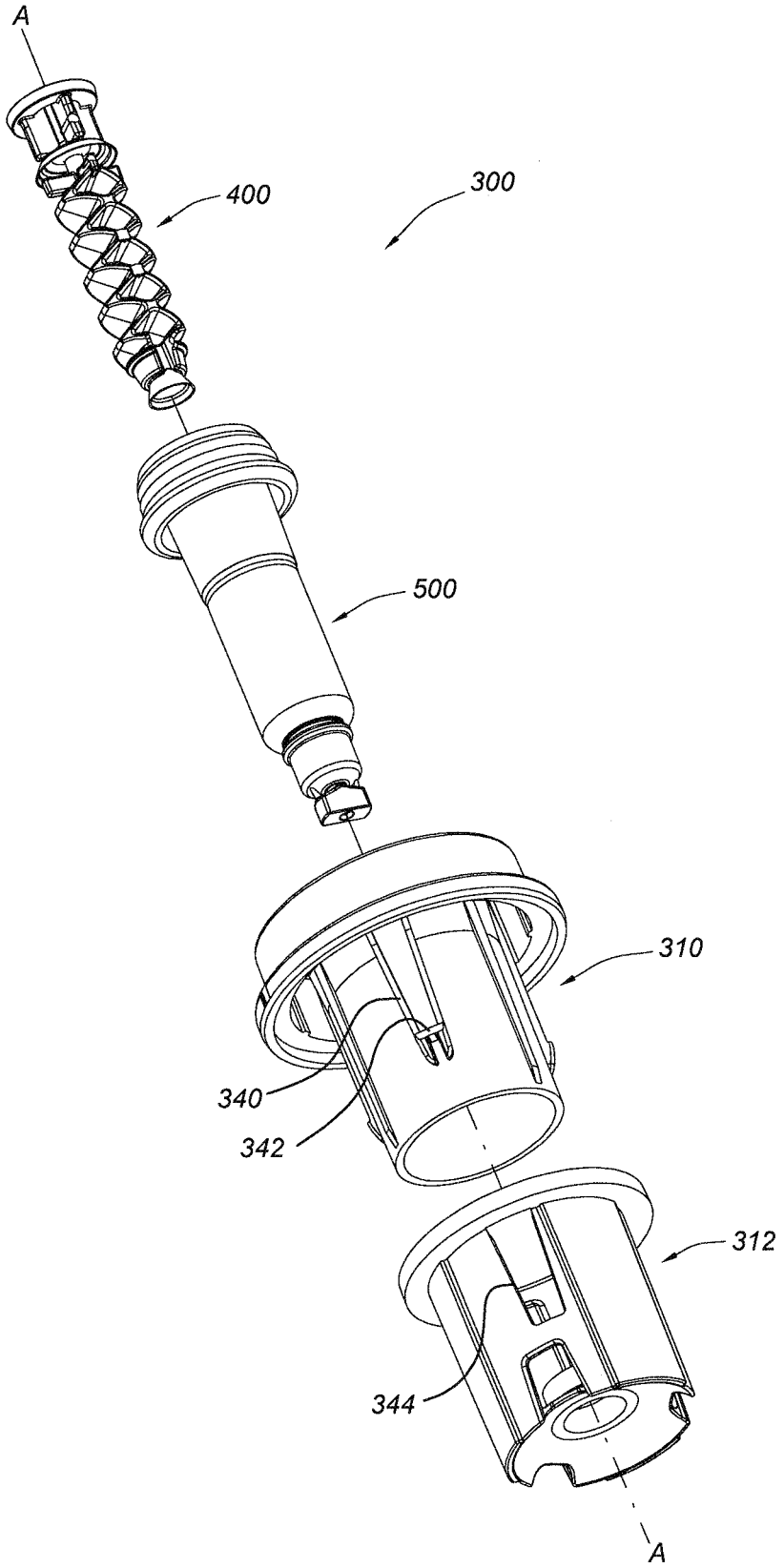
FIG. 5 shows the pump assembly of FIG. 3 in exploded perspective view.

FIG. 5 shows the pump assembly 300 of FIG. 3 in exploded perspective view illustrating the stationary sleeve 310, the sliding sleeve 312, spring 400 and pump body 500 axially aligned along axis A. The stationary sleeve 310 is provided on its outer surface with three axially extending guides 340, each having a detent surface 342. The sliding sleeve 312 is provided with three axially extending slots 344 through its outer surface, the functions of which will be described further below.

Figure 6:
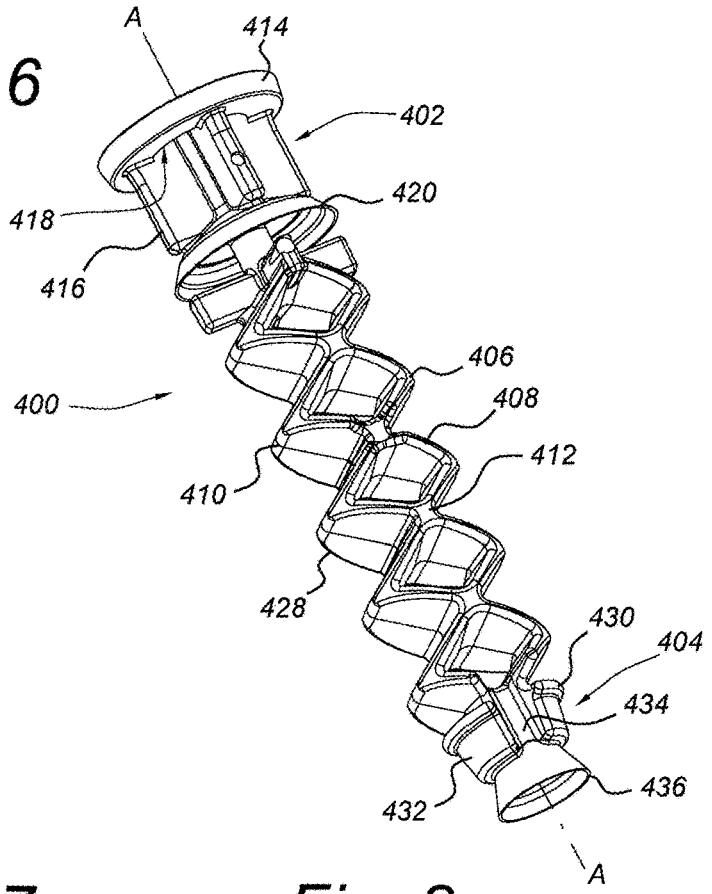
FIG. 6 shows the spring of FIG. 5 in perspective view.

FIG. 6 shows an enlarged perspective view of the spring 400, which is injection moulded in a single piece from ethylene octene material available from ExxonMobil Chemical Co. Spring 400 includes a first end portion 402 and a second end portion 404 aligned with each other along the axis A and joined together by a plurality of rhombus shaped spring sections 406. In this embodiment, five spring sections 406 are shown although the skilled person will understand that more or less such sections may be present according to the spring constant required. Each spring section 406 includes four flat leaves 408, joined together along hinge lines 410 that are parallel to each other and perpendicular to the axis A. The leaves 408 have curved edges 428 and the spring sections 406 join at adjacent corners 412.

The first end portion 402 includes a ring element 414 and a cross-shaped support element 416. An opening 418 is formed through the ring element 414. The cross-shaped support element 416 is interrupted intermediate its ends by an integrally formed first valve element 420 that surrounds the first end portion 402 at this point.

The second end portion 404 has a rib 430 and a frusto-conical shaped body 432 that narrows in a direction away from the first end portion 402. On its exterior surface the frusto-conical shaped body 432 is formed with two diametrically opposed flow passages 434. At its extremity it is provided with an integrally formed second valve element 436 projecting conically outwardly and extending away from the first end portion.

FIGS. 7-10 are respective front, side and first and second end elevations of the spring 400.

Figure 7:
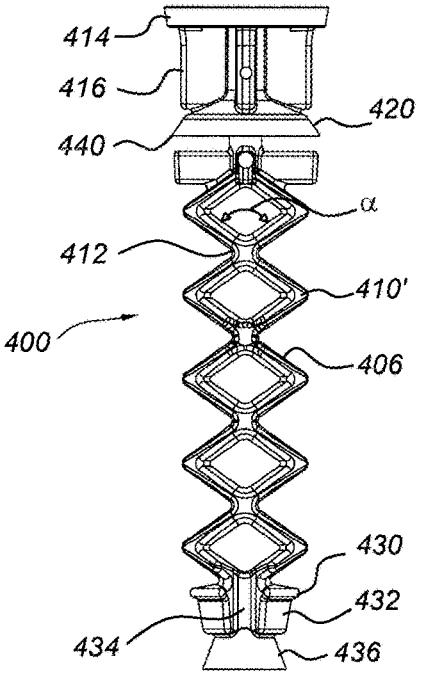
FIG. 7 shows the spring of FIG. 6 in front view.

Starting with FIG. 7, the ring element 414 and cross-shaped support element 416 can be seen, together with the first valve element 420. In this view it may be noted that the first valve element 420 is part spherical in shape and extends to an outer edge 440 that is slightly wider than the cross-shaped support element 416. Also in this view, the rhombus shape of the spring sections 406 can be clearly seen. The spring 400 is depicted in its unstressed condition and the corners 412 define an internal angle α of around 115°. The skilled person will recognise that this angle may be adjusted to modify the spring properties and may vary from 60 to 160 degrees, from 100 to 130 degrees, or between 90 and 120 degrees Also visible is the frusto-conical shaped body 432 of the second end portion 404 with rib 430, flow passages 434 and second valve element 436.

Figure 8:
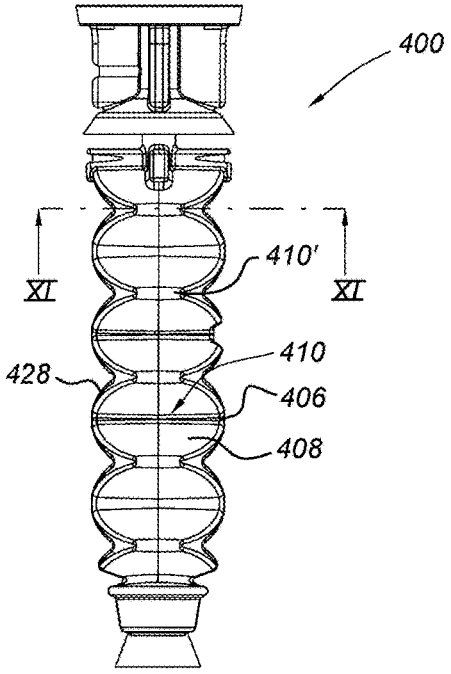
FIG. 8 shows the spring of FIG. 6 in side view.

FIG. 8 depicts the spring 400 in side view, viewed in the plane of the rhombus-shape of the spring sections 406. In this view, the hinge lines 410 can be seen, as can be the curved edges 428. It will be noted that the hinge lines 410 at the corners 412, where adjacent spring sections 406 join, are significantly longer than the hinge lines 410' where adjacent flat leaves 408 join.

Figure 9:
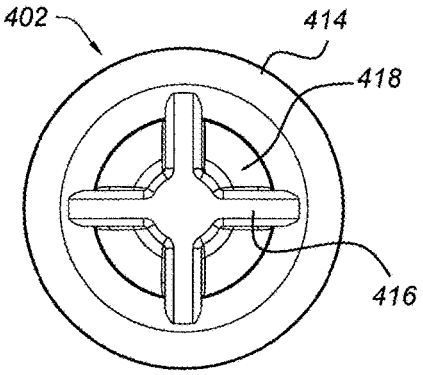
FIG. 9 shows the spring of FIG. 6 in top view.
Figure 10:
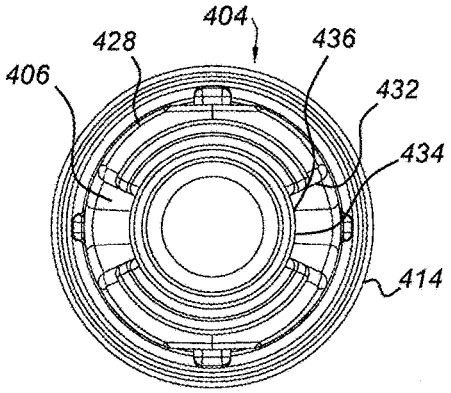
FIG. 10 shows the spring of FIG. 6 in bottom view.

FIG. 9 is a view onto the first end portion 402 showing the ring element 414 with the cross-shaped support element 416 viewed through opening 418. FIG. 10 shows the spring 400 viewed from the opposite end to FIG. 9, with the second valve element 436 at the centre and the frusto-conical shaped body 432 of the second end portion 404 behind it, interrupted by flow passages 434. Behind the second end portion 404, the curved edges 428 of the adjacent spring section 406 can be seen, which in this view define a substantially circular shape. In the shown embodiment, the ring element 414 is the widest portion of the spring 400.

Figure 11:
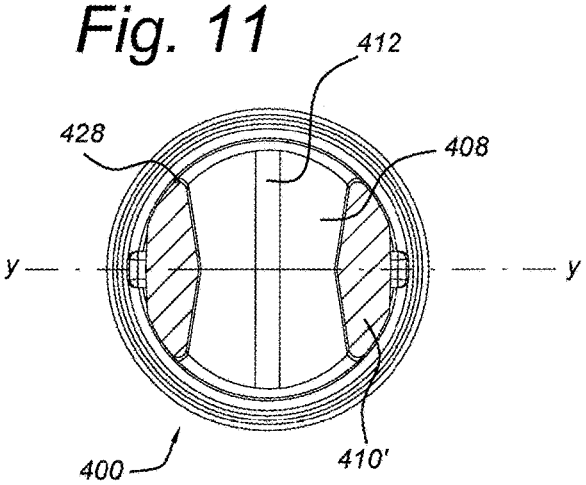
FIG. 11 shows a cross-sectional view through the spring of FIG. 8 along line XI-XI.

FIG. 11, is a cross-sectional view along line XI-XI in FIG. 8 showing the variation in thickness through the flat leaves 408 at the hinge line 410'. As can be seen, each leaf 408 is thickest at its mid-line at location Y-Y and is feathered towards the curved edges 428, which are thinner. This tapering shape concentrates the material strength of the spring towards the mid-line and concentrates the force about the axis A.

Figure 12:
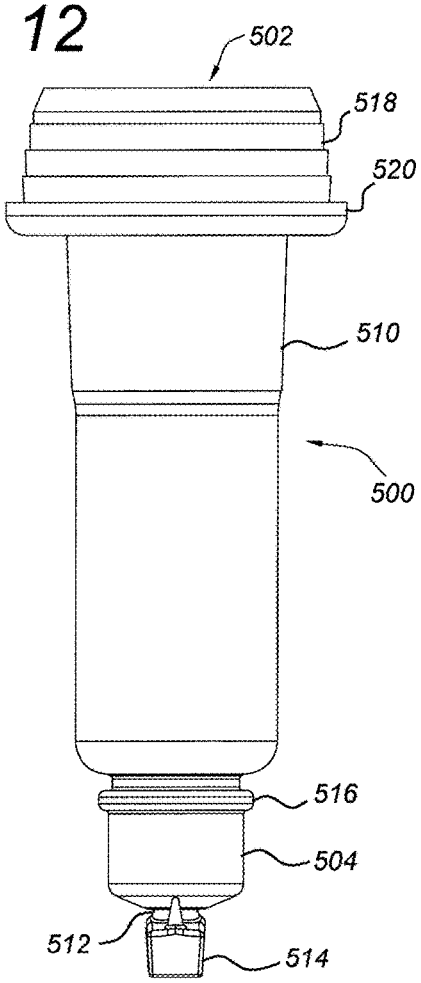
FIG. 12 shows the pump chamber of FIG. 5 in front view.

FIG. 12 shows the pump body 500 of FIG. 5 in front elevation in greater detail. In this embodiment, pump body 500 is also manufactured of the same plastomer material as the spring 400. This is advantageous both in the context of manufacturing and disposal, although the skilled person will understand that different materials may be used for the respective parts. Pump body 500 includes a pump chamber 510, which extends from a pump inlet 502 to a pump outlet 504. The pump outlet 504 is of a smaller diameter than the pump chamber 510 and terminates in a nozzle 512, which is initially closed by a twist-off closure 514. Set back from the nozzle 512 is an annular protrusion 516. The pump inlet 502 includes a boot portion 518 that is rolled over on itself and terminates in a thickened rim 520.

Figure 13:
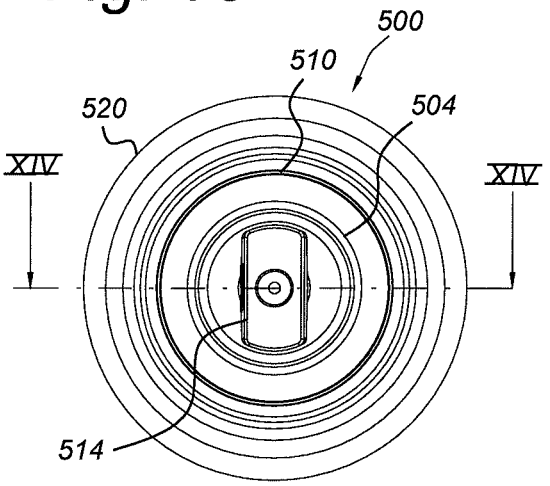
FIG. 13 shows a bottom view of the pump body directed onto the pump outlet.

FIG. 13 shows an end view of the pump body 500 directed onto the pump outlet 504. The pump body 500 is rotationally symmetrical, with the exception of the twist-off closure 514, which is rectangular. The variation in diameter between the pump outlet 504, the pump chamber 510 and the thickened rim 520 can be seen.

Figure 14:
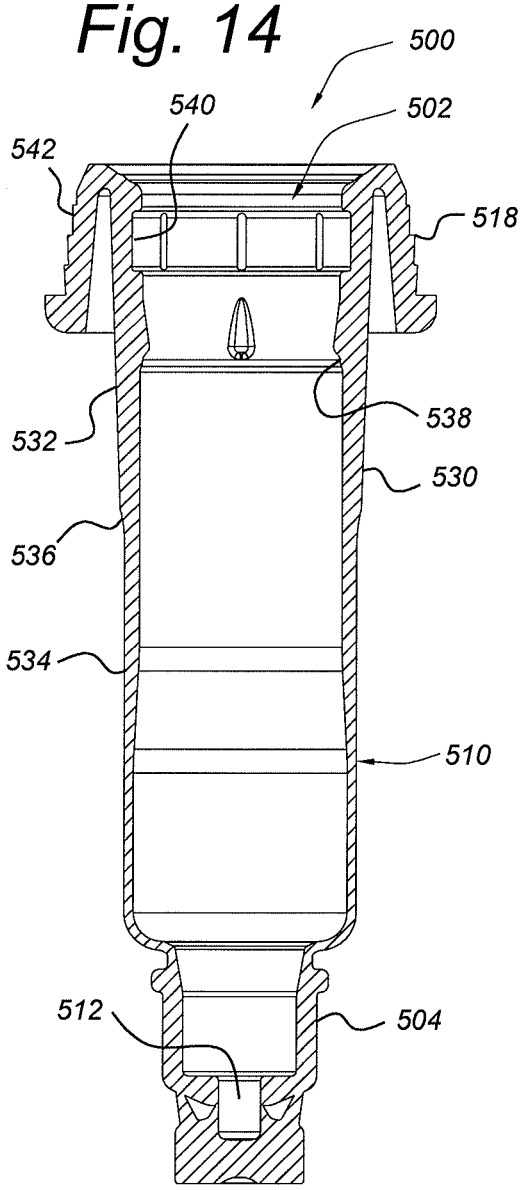
FIG. 14 is a longitudinal cross-sectional view of the pump body taken in direction XIV-XIV in FIG. 13.

FIG. 14 is a longitudinal cross-sectional view of the pump body 500 taken in direction XIV-XIV in FIG. 13. The pump chamber 510 includes a flexible wall 530, having a thick-walled section 532 adjacent to the pump inlet 502 and a thin-walled section 534 adjacent to the pump outlet 504. The thin-walled section 534 and the thick-walled section 532 join at a transition 536. The thin-walled section 534 tapers in thickness from the transition 536 with a decreasing wall thickness towards the pump outlet 504. The thick-walled section 532 tapers in thickness from the transition 536 with an increasing wall thickness towards the pump inlet 502. The thick-walled section 532 also includes an inlet valve seat 538 at which the internal diameter of the pump chamber 510 reduces as it transitions to the pump inlet 502. In addition to the variations in wall thickness of the pump chamber 510, there is also provided an annular groove 540 within the pump body 500 at the pump inlet 502 and sealing ridges 542 on an exterior surface of the boot portion 518.

Figure 15:
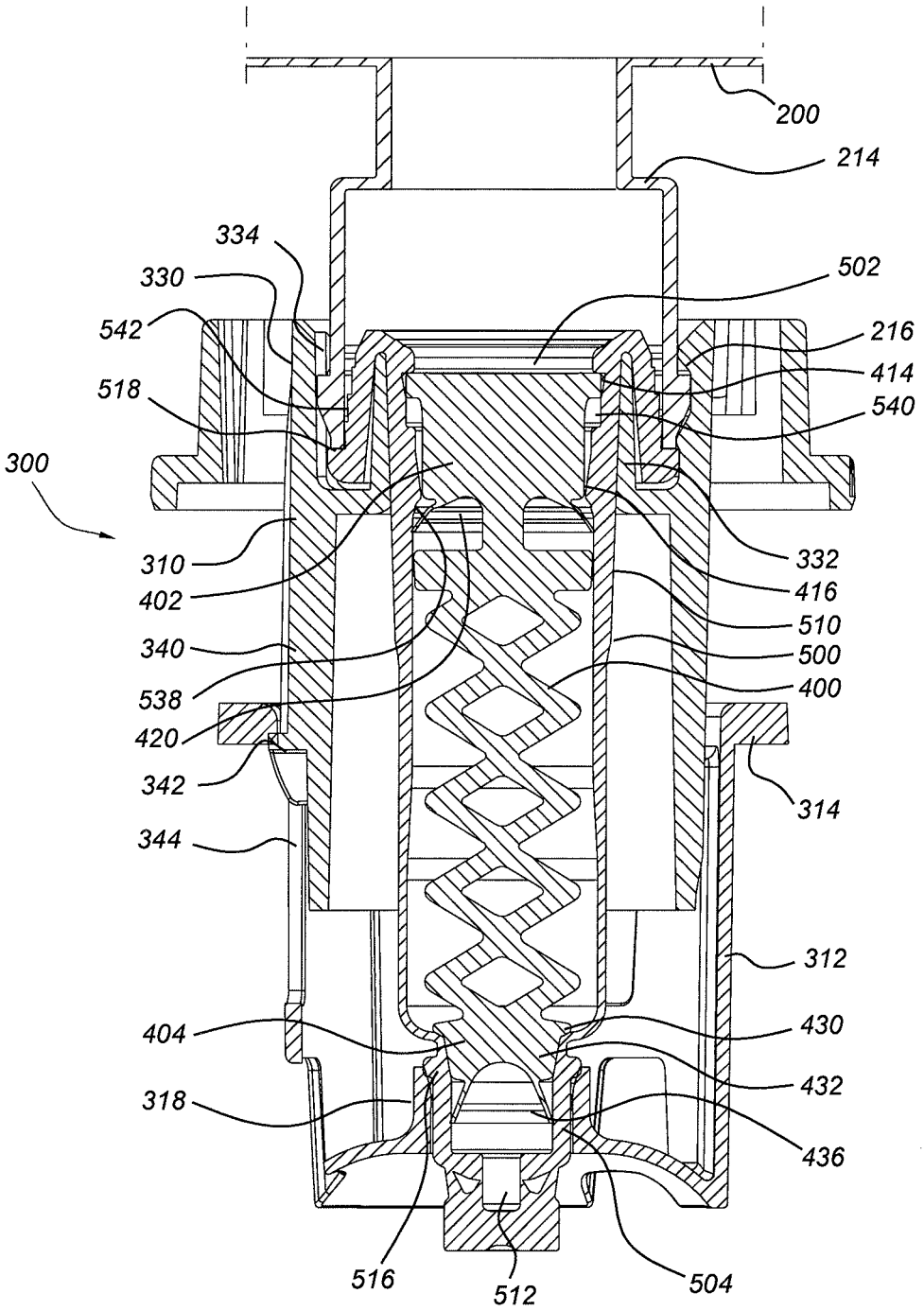
FIGS. 15-18 are cross-sectional views through the pump assembly of FIG. 3 in various stages of operation.

FIG. 15 is a cross-sectional view through the pump assembly 300 of FIG. 3, showing the spring 400, the pump body 500 and the sleeves 310, 312, connected together in a position prior to use. Stationary sleeve 310 includes a socket 330 opening towards its upper side. The socket 330 has an upwardly extending male portion 332 sized to engage within the boot portion 518 of the pump body 500. The socket 330 also includes inwardly directed cams 334 on its inner surface of a size to engage with the connecting flange 216 on the rigid neck 214 of container 200 in a snap connection. The engagement of these three portions results in a fluid tight seal, due to the flexible nature of the material of the pump body 500 being gripped between the relatively more rigid material of the connecting flange 216 and the stationary sleeve 310. Additionally, the sealing ridges 542 on the exterior surface of the boot portion 518 engage within the rigid neck 214 in the manner of a stopper. In the depicted embodiment, this connection is a permanent connection but it will be understood that other e.g. releasable connections may be provided between the pump assembly 300 and the container 200.

FIG. 15 also depicts the engagement between the spring 400 and the pump body 500. The inlet portion 402 of the spring 400 is sized to fit within the pump inlet 502 with the ring element 414 engaged in the groove 540 and the cross-shaped support element 416 engaging against the interior surface of the pump inlet 502 and the adjacent pump chamber 510. The first valve element 420 rests against the inlet valve seat 538 with a slight pre-load, sufficient to maintain a fluid-tight seal in the absence of any external pressure.

At the other end of the pump body 500, the outlet portion 404 engages within the pump outlet 504. The rib 430 has a greater diameter than the pump outlet 504 and serves to position the frusto-conical shaped body 432 and the second valve element 436 within the pump outlet 504. The outside of the pump outlet 504 also engages within the orifice 318 of the sliding sleeve 312 with the nozzle 512 slightly protruding. The annular protrusion 516 is sized to be slightly larger than the orifice 318 and maintains the pump outlet 504 at the correct position within the orifice 318. The second valve element 436 has an outer diameter that is slightly larger than the inner diameter of the pump outlet 504, whereby a slight pre-load is also applied, sufficient to maintain a fluid-tight seal in the absence of any external pressure.

FIG. 15 also shows how the sleeves 310, 312 engage together in operation. The sliding sleeve 312 is slightly large in diameter than the stationary sleeve 310 and encircles it. The three axial guides 340 on the outer surface of the stationary sleeve 310 engage within respective slots 344 in the sliding sleeve. In the position shown in FIG. 15, the spring 400 is in its initial condition being subject to a slight pre-compression and the detent surfaces 342 engage against the actuating flange 314.

In the position shown in FIG. 15, the container 200 and pump assembly 300 are permanently connected together and are supplied and disposed of as a single disposable unit. The snap connection between socket 330 and the connecting flange 216 on the container 200 prevents the stationary sleeve 310 from being separated from the container 200. The detent surfaces 342 prevent the sliding sleeve 312 from being removed from its position around the stationary sleeve 310 and the pump body 500 and spring 400 are retained within the sleeves 310, 312.

Figure 16:
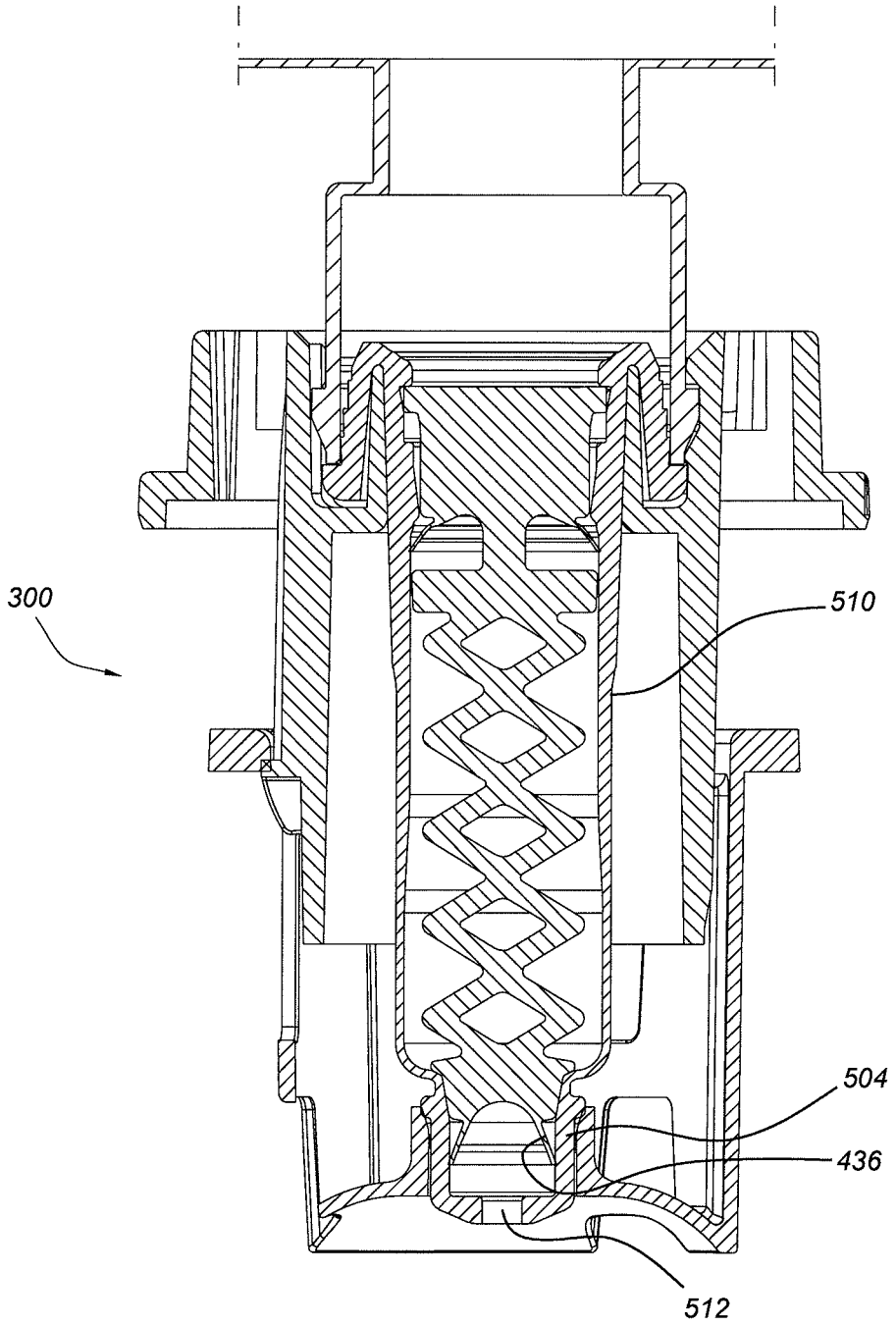

FIG. 16 shows a similar view to FIG. 15 with the twist-off closure 514 removed. The pump assembly 300 is now ready for use and may be installed into a dispenser 100 as shown in FIG. 2. For the sake of the following description, the pump chamber 510 is full of fluid to be dispensed although it will be understood that on first opening of the twist-off closure 514, the pump chamber 510 may be full of air. In this condition, the second valve element 436 seals against the inner diameter of the pump outlet 504, preventing any fluid from exiting through the nozzle 512.

Figure 17:
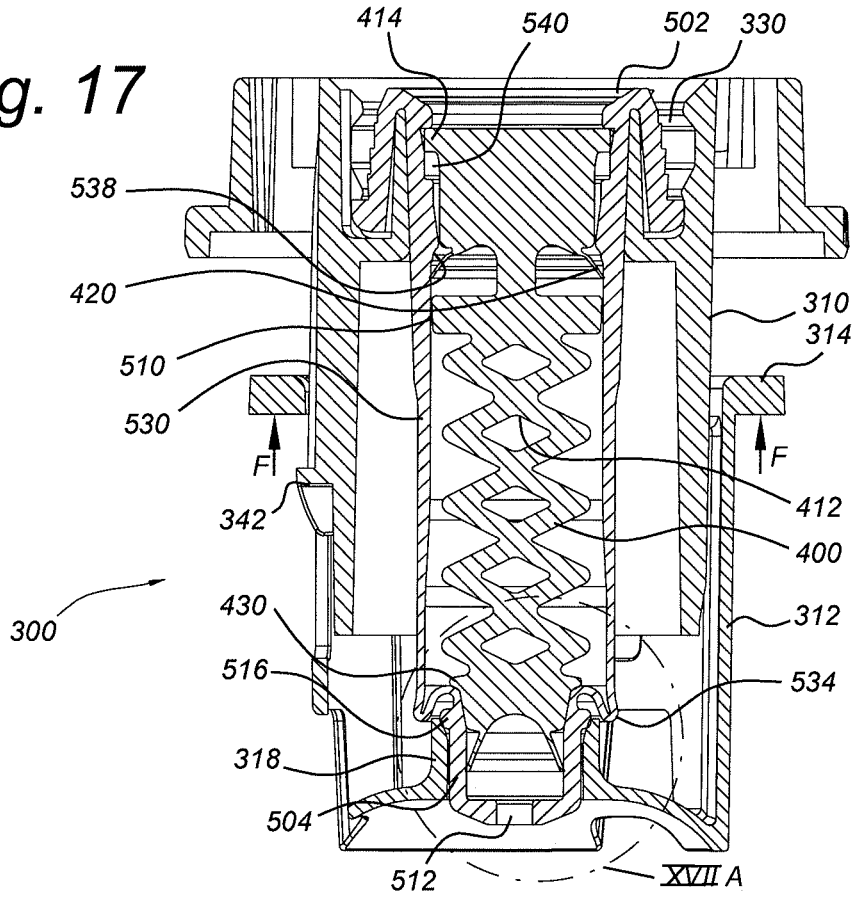

FIG. 17 shows the pump assembly 300 of FIG. 16 as actuation of a dispensing stroke is commenced, corresponding to the action described in relation to FIGS. 4A and 4B. As previously described in relation to those figures, engagement of actuator 124 by a user causes the engagement portion 134 to act against the actuating flange 314 exerting a force F. In this view, the container 200 has been omitted for the sake of clarity.

The force F causes the actuating flange 314 to move out of engagement with the detent surfaces 342 and the sliding sleeve 312 to move upwards with respect to the stationary sleeve 310. This force is also transmitted by the orifice 318 and the annular protrusion 516 to the pump outlet 504, causing this to move upwards together with the sliding sleeve 312. The other end of the pump body 400 is prevented from moving upwards by engagement of the pump inlet 502 with the socket 330 of the stationary sleeve 310.

The movement of the sliding sleeve 312 with respect to the stationary sleeve 310 causes an axial force to be applied to the pump body 400. This force is transmitted through the flexible wall 530 of the pump chamber 510, which initially starts to collapse at its weakest point, namely the thin walled section 534 adjacent to the pump outlet 504. As the pump chamber 510 collapses, its volume is reduced and fluid is ejected through the nozzle 512. Reverse flow of fluid through the pump inlet 502 is prevented by the first valve element 420, which is pressed against the inlet valve seat 538 by the additional fluid pressure within the pump chamber 510.

Additionally, the force is transmitted through the spring 400 by virtue of the engagement between the rib 430 and the pump outlet 504 and the ring element 414 being engaged in the groove 540 at the pump inlet 502. This causes the spring 400 to compress, whereby the internal angle $\alpha$ at the corners 412 increases.

Figure 17A:
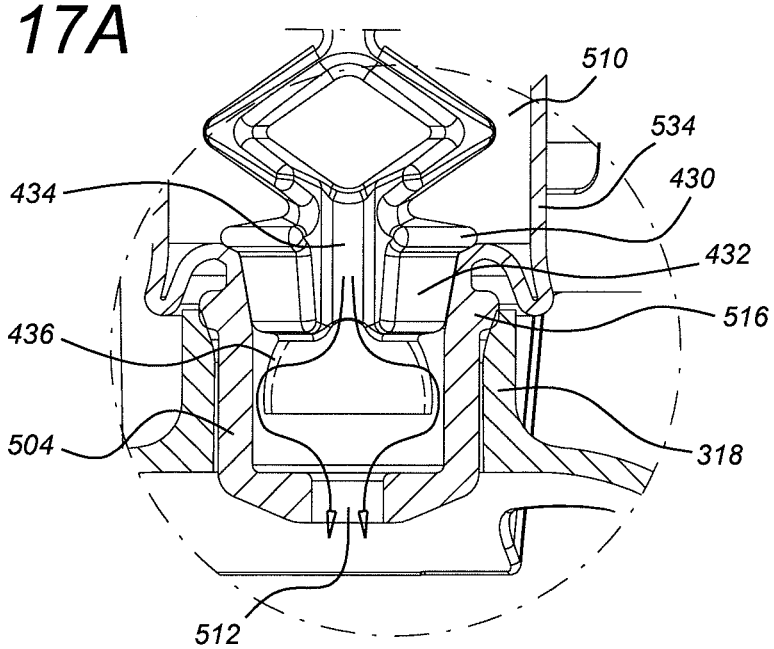
FIG. 17A is a detail in perspective of the pump outlet of FIG. 17.

FIG. 17A is a detail in perspective of the pump outlet 504 of FIG. 17, showing in greater detail how second valve element 436 operates. In this view, spring 400 is shown unsectioned. As can be seen, thin walled section 534 has collapsed by partially inverting on itself adjacent to the annular protrusion 516. Below the annular protrusion 516, the pump outlet 504 has a relatively thicker wall and is supported within the orifice 318, maintaining its form and preventing distortion or collapse. As can also be seen in this view, rib 430 is interrupted at flow passage 434, which extends along the outer surface of the frusto-conical shaped body 432 to the second valve element 436. This flow passage 434 allows fluid to pass from the pump chamber 510 to engage with the second valve element 436 and exert a pressure onto it. The pressure causes the material of the second valve element 436 to flex away from engagement with the inner wall of the pump outlet 504, whereby fluid can pass the second valve element 436 and reach the nozzle 512. The precise manner in which the second valve element 436 collapses, will depend upon the degree and speed of application of the force F and other factors such as the nature of the fluid, the pre-load on the second valve element 436 and its material and dimensions. These may be optimised as required.

Figure 18:
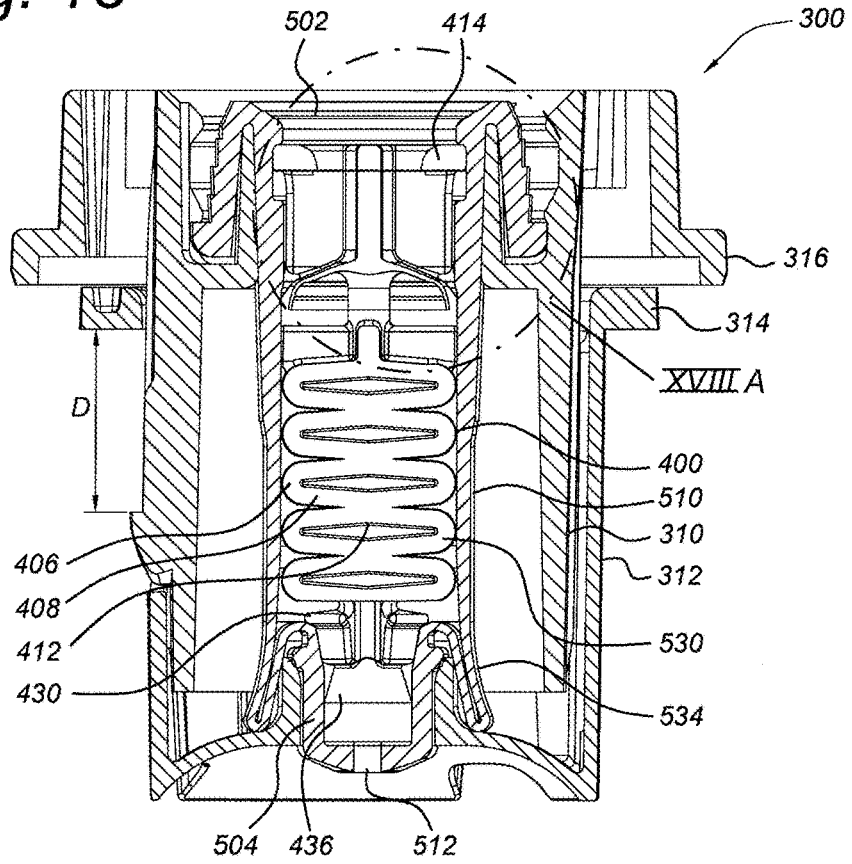

FIG. 18 shows the pump assembly 300 of FIG. 17 in fully compressed state on completion of an actuation stroke. The sliding sleeve 312 has moved upwards a distance D with respect to the initial position of FIG. 16 and the actuating flange 314 has entered into abutment with the locating flange 316. In this position, pump chamber 510 has collapsed to its maximum extent whereby the thin walled section 534 has fully inverted. The spring 400 has also collapsed to its maximum extent with all of the rhombus-shaped spring section 406 fully collapsed to a substantially flat configuration in which the leaves 408 lie close against each other and, in fact all of the leaves 408 are almost parallel to each other. It will be noted that although reference is given to fully compressed and collapsed conditions, this need not be the case and operation of the pump assembly 300 may take place over just a portion of the full range of movement of the respective components.

As a result of the spring sections 406 collapsing, the internal angle $\alpha$ at the corners 412 approaches 180° and the overall diameter of the spring 400 at this point increases. As illustrated in FIG. 18, the spring 400, which was initially slightly spaced from the flexible wall 530, engages into contact with the pump chamber. At least in the region of the thin walled section 534, the spring sections 406 exert a force on the flexible wall 530, causing it to stretch.

Once the pump has reached the position of FIG. 18, no further compression of the spring 400 takes place and fluid ceases to flow through the nozzle 512. The second valve element 436 closes again into sealing engagement with the pump outlet 504. In the illustrated embodiment, the stroke, defined by distance D is around 14 mm and the volume of fluid dispensed is about 1.1 ml. It will be understood that these distances and volumes can be adjusted according to requirements.

After the user releases the actuator 124 or the force F is otherwise discontinued, the compressed spring 400 will exert a net restoring force on the pump body 500. The spring depicted in the present embodiment exerts an axial force of around 20 N in its fully compressed condition. This force, acts between the ring element 414 and the rib 430 and exerts a restoring force between the pump inlet 502 and the pump outlet 504 to cause the pump chamber 510 to revert to its original condition. The pump body 500 by its engagement with the sleeves 310, 312 also causes these elements to return towards their initial position as shown in FIG. 16.

As the spring 400 expands, the pump chamber 510 also increases in volume leading to an under pressure within the fluid contained within the pump chamber 510. The second valve element 436 is closed and any under pressure causes the second valve element 436 to engage more securely against the inner surface of the pump outlet 504.

Figure 18A:
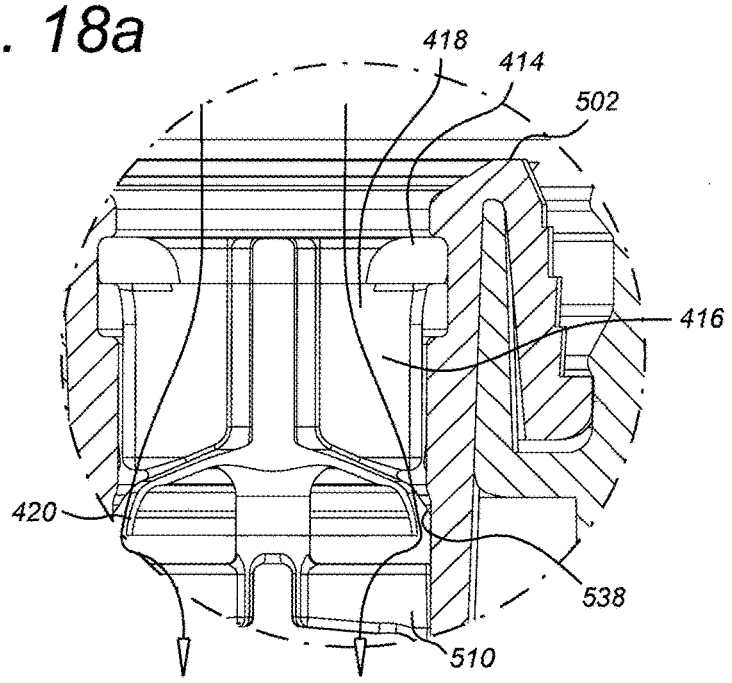
FIG. 18A is a detail in perspective of the pump inlet of FIG. 18.

FIG. 18A shows a perspective detail of part of the pump inlet 502 of FIG. 18. At the pump inlet 502, the first valve element 420 can flex away from the inlet valve seat 538 due to the lower pressure in the pump chamber 510 compared to that in the container 200. This causes fluid to flow into the pump chamber 510 through the rigid neck 214 of the container 200 and the opening 418 formed through the ring element 414 and over the cross-shaped support element 416.

As the skilled person appreciates, the spring may provide a major restoring force during the return stroke. However, as the spring 400 extends, its force may also be partially augmented by radial pressure acting on it from the flexible wall 530 of the pump chamber 510. The pump chamber 510 may also exert its own restoring force on the sliding sleeve 312 due to the inversion of the thin walled section 534, which attempts to revert to its original shape. Neither the restoring force of the spring 400 nor that of the pump chamber 510 is linear but the two may be adapted together to provide a desirable spring characteristic. In particular, the pump chamber 510 may exert a relatively strong restoring force at the position depicted in FIG. 17, at which the flexible wall 530 just starts to invert. The spring 400 may exert its maximum restoring force when it is fully compressed in the position according to FIG. 18.

The spring 400 of FIGS. 6 to 11 and pump body 500 of FIGS. 12 to 14 are dimensioned for pumping a volume of around 1-2 ml, e.g. around 1.1 ml. In a pump dimensioned for 1.1 ml, the flat leaves 408 have a length of around 7 mm, measured as the distance between hinge lines 410 about which they flex. They have a thickness at their mid-lines of around 1 mm. The overall length of the spring is around 58 mm. The pump body 400 has an overall length of around 70 mm, with the pump chamber 510 comprising around 40 mm and having an internal diameter of around 15 mm and a minimal wall thickness of around 0.5 mm. The skilled person will understand that these dimensions are exemplary.

The pump/spring may develop a maximum resistance of between 1 N and 50 N, or between 20 N and 25 N on compression. Furthermore, the pump/spring bias on the reverse stroke for an empty pump may be between 1 N and 50 N, between 1 N and 30 N, between 5 N and 20 N, or between 10 N and 15 N. In general, the compression and bias forces may depend on and be proportional to the intended volume of the pump. The values given above may be appropriate for a 1 ml pump stroke.

Thus, the present disclosure has been described by reference to the embodiments discussed above. It will be recognized that these embodiments are susceptible to various modifications and alternative forms well known to those of skill in the art without departing from the spirit and scope of the invention as defined by the appended claims.

The invention claimed is:

1. A pump for dispensing a fluid product from a product container, the pump comprising:

a unitary pump body defining an axis A and comprising a pump chamber, a pump inlet and a pump outlet, the pump chamber being collapsible over an axially directed pumping stroke from an initial condition to a collapsed condition and being biased to return to its initial condition in a return stroke;

an inlet valve for allowing one way passage of fluid through the pump inlet and into the pump chamber;

an outlet valve for allowing one way passage of fluid from the pump chamber through the pump outlet; and an axially compressible spring located inside the pump chamber and arranged to at least partially support the pump body during its collapse, the spring comprising a first end portion that engages within the pump inlet, a second end portion that engages within the pump outlet and a spring body therebetween, the spring body comprising a plurality of axially-aligned, leaf-spring sections, each of which can be compressed in the axial direction from an initial open condition to a compressed condition and is biased to subsequently expand to its open condition, whereby axial compression of the spring generates a restoring force, at least partially biasing the pump chamber to its initial condition.

2. The pump according to claim 1, wherein the spring, the pump body, or both comprises plastomer material.

3. The pump according to claim 1, wherein the spring at least partially supports against an internal surface of the pump chamber during its collapse.

4. The pump according to claim 1, wherein the inlet valve comprises a first valve element, integrally formed with the first end portion of the spring.

5. The pump according to claim 1, wherein the outlet valve comprises a second valve element, integrally formed with the second end portion of the spring.

6. The pump according to claim 1, wherein the pump inlet has an inner diameter greater than that of the pump outlet and the spring tapers from the first end portion to the second end portion.

7. The pump according to claim 1, wherein the pump body, the spring, or both comprises an ethylene alpha olefin copolymer.

8. The pump according to claim 1, wherein the pump body, the spring, or both comprises a material having a flexural modulus according to ASTM D-790 in the range of 15-80 MPa.

9. The pump according to claim 1, wherein the pump body, the spring, or both comprises a material having an ultimate tensile strength according to ASTM D-638 in the range of 3-11 MPa.

10. The pump according to claim 1, wherein the pump body, the spring, or both comprises a material having a melt flow index according to ISO standard 1133-1 of at least 10 dg/min.

11. The pump according to claim 1, wherein the pump chamber comprises a cylindrical wall that is relatively more flexible than the pump inlet and pump outlet.

12. The pump according to claim 11, wherein the cylindrical wall is arranged such that its collapse generates a restoring force tending to bias the pump chamber to the initial condition.

13. The pump according to claim 12, wherein the pump outlet has a diameter that is different from a diameter of the cylindrical wall and the cylindrical wall can collapse by inverting whereby the pump outlet is at least partially received within the pump chamber or vice-versa.

14. The pump according to claim 1, wherein the pump outlet defines a nozzle, integrally formed with a frangible closure element.

15. The pump according to claim 1, wherein the spring alone biases the pump chamber to return to its initial condition.

16. The pump according to claim 1, wherein the pump chamber and the spring together bias the pump chamber to return to its initial condition, whereby the spring provides a major biasing force at least during an initial part of the return stroke.

17. The pump according to claim 1, wherein the pump chamber and the spring together bias the pump chamber to return to its initial condition, whereby the pump chamber provides a greater biasing force over a final part of the return stroke than over an initial part of the return stroke.

18. The pump according to claim 1, wherein the pump body and the spring are injection molded of the same material.

19. The pump according to claim 1, wherein the pump body and the spring are injection molded of different materials.

20. The pump according to claim 1, consisting of only two components, namely the pump body and the spring, whereby the pump body and the spring comprise portions that interact to define a one-way inlet valve and a one-way outlet valve.

21. A pump assembly comprising:

the pump according to claim 1; and a pair of sleeves, arranged to slidably interact to guide the pump during a pumping stroke, including a stationary sleeve engaged with the pump inlet and a sliding sleeve engaged with the pump outlet.

22. The pump assembly according to claim 21, wherein the stationary sleeve and sliding sleeve have mutually interacting detent surfaces that prevent their separation and define the pumping stroke.

23. The pump assembly according to claim 21, wherein the stationary sleeve comprises a socket having an axially extending male portion and the pump inlet has an outer diameter, dimensioned to engage within the socket and comprises a boot portion, rolled over on itself to receive the male portion.

24. A disposable fluid dispensing package, comprising: the pump according to claim 1 sealingly connected to a collapsible product container.

25. A method of dispensing a fluid from the pump according to claim 1, the method comprising:

exerting an axial force on the pump body between the pump inlet and the pump outlet to overcome a bias force and cause the pump chamber to collapse during a pumping stroke from an initial condition to a collapsed condition, whereby fluid contained in the pump chamber is dispensed through the pump outlet; and releasing the axial force, allowing the bias force to return the pump chamber to its initial condition in a return stroke, whereby fluid is drawn into the pump chamber through the pump inlet.

* * * * *